US007410380B1

(12) United States Patent
Speigle

(10) Patent No.: US 7,410,380 B1
(45) Date of Patent: Aug. 12, 2008

(54) VOICE AND DATA TELECOMMUNICATIONS CONNECTOR

(75) Inventor: Rickey L. Speigle, Warsaw, IN (US)

(73) Assignee: Embarq Holdings Company, LLC, Overland Park, KS (US)

( * ) Notice: Subject to any disclaimer, the term of this patent is extended or adjusted under 35 U.S.C. 154(b) by 97 days.

(21) Appl. No.: 11/657,207

(22) Filed: Jan. 24, 2007

(51) Int. Cl.
*H01R 4/60* (2006.01)

(52) U.S. Cl. ..... 439/215; 438/676

(58) Field of Classification Search ..... 439/214–216, 439/625–626, 640, 651, 660, 676
See application file for complete search history.

(56) References Cited

U.S. PATENT DOCUMENTS 4,239,320 A * 12/1980 Hesse et al. ..... 439/640
5,055,068 A * 10/1991 Machura et al. ..... 439/581
5,190,479 A * 3/1993 Jordi ..... 439/620.22
6,325,650 B1 * 12/2001 Wilson et al. ..... 439/215
6,416,339 B1 * 7/2002 Snow et al. ..... 439/215

* cited by examiner

*Primary Examiner*—Khiem Nguyen
(74) *Attorney, Agent, or Firm*—Sonnenschein Nath & Rosenthal LLP

(57) ABSTRACT

The present voice and data telecommunications connector includes a set of wires each having a first end terminating in a first 50-pin amphenol connector for connecting to a 50-pin amphenol socket of a converged voice and data telecommunications device; a first group of said set of wires each having a second end terminating in a 50-pin amphenol connector for connecting to a 50-pin amphenol trunk socket of a compact integrated communications system device; and a second group of the set of wires each having a second end terminating in a 50-pin amphenol connector for connecting to a 50-pin amphenol station socket of the compact integrated communications system device. Another embodiment provides for a voice and data telecommunications connector that includes a set of wires having a first end terminating in a 50-pin amphenol connector and three 50-pin amphenol connectors for connecting to a modular integrated communications device.

11 Claims, 7 Drawing Sheets

700

| 702 PINS | 704 25 PAIR FROM BCM | 706 PINS | 708 TRUNK AMP | 710 PINS | 712 STATION AMP |
|---|---|---|---|---|---|
| 1 & 26 | 1 LINE 1 | 1 & 26 | LINE 1 | 1 & 26 | DIGITAL 221 |
| 2 & 27 | 2 LINE 2 | 2 & 27 | LINE 2 | 2 & 27 | DIGITAL 222 |
| 3 & 28 | 3 LINE 3 | | | 3 & 28 | DIGITAL 223 |
| 4 & 29 | 4 LINE 4 | | | 4 & 29 | DIGITAL 224 |
| 5 & 30 | 5 ANALOG 233 | 5 & 30 | LINE 3 | 5 & 30 | DIGITAL 225 |
| 6 & 31 | 6 ANALOG 234 | 6 & 31 | LINE 4 | 6 & 31 | DIGITAL 226 |
| 7 & 32 | 7 ANALOG 235 | | | 7 & 32 | DIGITAL 227 |
| 8 & 33 | 8 ANALOG 236 | | | 8 & 33 | DIGITAL 228 |
| 9 & 34 | 9*VACANT* | | | 9 & 34 | DIGITAL 229 |
| 10 & 35 | 10 AUX RINGER | | | 10 & 35 | DIGITAL 230 |
| 11 & 36 | 11 PAGE RELAY | | | 11 & 36 | DIGITAL 231 |
| 12 & 37 | 12 PAGE OUTPUT | | | 12 & 37 | DIGITAL 232 |
| 13 & 38 | 13 MUSIC | | | 13 & 38 | ANALOG 233 |
| 14 & 39 | 14 DIGITAL 232 | | | 14 & 39 | ANALOG 234 |
| 15 & 40 | 15 DIGITAL 231 | | | 15 & 40 | ANALOG 235 |
| 16 & 41 | 16 DIITAL 230 | | | 16 & 41 | ANALOG 236 |
| 17 & 42 | 17 DIGITAL 229 | | | 17 & 42 | *VACANT* |
| 18 & 43 | 18 DIGITAL 228 | | | | |
| 19 & 44 | 19 DIGITAL 227 | | | | |
| 20 & 45 | 20 DIGITAL 226 | | | | |
| 21 & 46 | 21 DITIGAL 225 | | | | |
| 22 & 47 | 22 DIGITAL 224 | | | | |
| 23 & 48 | 23 DIGITAL 223 | 23 & 48 | MUSIC | | |
| 24 & 49 | 24 DIGITAL 222 | 24 & 49 | EXTERNAL PAGE | | |
| 25 & 50 | 25 DIGITAL 221 | 25 & 50 | PAGE | 25 & 50 | AUX RINGER |

Figure 7

802 804 806 808 810 812 814 816

| PINS | 25 PAIR FROM BCM | PINS | TRUNK AMP | PINS | STATION AUX. AMP | PINS | STATION AMP |
|---|---|---|---|---|---|---|---|
| 1 & 26 | 1 LINE 1 | 1 & 26 | LINE 1 | | | 1 & 26 | DIGITAL 221 |
| 2 & 27 | 2 LINE 2 | 2 & 27 | LINE 2 | | | 2 & 27 | DIGITAL 222 |
| 3 & 28 | 3 LINE 3 | | | | | 3 & 28 | DIGITAL 223 |
| 4 & 29 | 4 LINE 4 | | | | | 4 & 29 | DIGITAL 224 |
| 5 & 30 | 5 ANALOG 233 | 5 & 30 | LINE 3 | | | 5 & 30 | DIGITAL 225 |
| 6 & 31 | 6 ANALOG 234 | 6 & 31 | LINE 4 | | | 6 & 31 | DIGITAL 226 |
| 7 & 32 | 7 ANALOG 235 | | | | | 7 & 32 | DIGITAL 227 |
| 8 & 33 | 8 ANALOG 236 | | | | | 8 & 33 | DIGITAL 228 |
| 9 & 34 | 9*VACANT* | | | | | 9 & 34 | DIGITAL 229 |
| 10 & 35 | 10 AUX RINGER | | | | | 10 & 35 | DIGITAL 230 |
| 11 & 36 | 11 PAGE RELAY | | | | | 11 & 36 | DIGITAL 231 |
| 12 & 37 | 12 PAGE OUTPUT | | | | | 12 & 37 | DIGITAL 232 |
| 13 & 38 | 13 MUSIC | | | | | 13 & 38 | ANALOG 233 |
| 14 & 39 | 14 DIGITAL 232 | | | | | 14 & 39 | ANALOG 234 |
| 15 & 40 | 15 DIGITAL 231 | | | 15 & 40 | PAGE | 15 & 40 | ANALOG 235 |
| 16 & 41 | 16 DIITAL 230 | | | 16 & 41 | EXTERNA L PAGE | 16 & 41 | ANALOG 236 |
| 17 & 42 | 17 DIGITAL 229 | | | 17 & 42 | MUSIC | 17 & 42 | *VACANT* |
| 18 & 43 | 18 DIGITAL 228 | | | | | | |
| 19 & 44 | 19 DIGITAL 227 | | | 19 & 44 | AUX RINGER | | |
| 20 & 45 | 20 DIGITAL 226 | | | | | | |
| 21 & 46 | 21 DITIGAL 225 | | | | | | |
| 22 & 47 | 22 DIGITAL 224 | | | | | | |
| 23 & 48 | 23 DIGITAL 223 | | | | | | |
| 24 & 49 | 24 DIGITAL 222 | | | | | | |
| 25 & 50 | 25 DIGITAL 221 | | | | | | |

800

Figure 8

VOICE AND DATA TELECOMMUNICATIONS CONNECTOR

FIELD OF THE INVENTION

The field of the invention is directed to a connector for interconnecting a key system telecommunications device to a voice and data telecommunications device.

BACKGROUND OF THE INVENTION

Private branched exchanges ("PBXs") and key telephone systems have been used for many decades to provide small to large businesses with multi-line access to the public switched telephone network ("PSTN"). Typically, PBXs have been used by large companies to enable their employees to share incoming and outgoing PSTN trunk lines, so that the company does not have to dedicate individual PSTN lines to each employee. Key telephone systems, commonly referred to "key systems," are typically smaller versions of PBXs that historically use individual lines instead of sharing anonymous trunk lines. Nevertheless, technology has all but eliminated this distinction by enabling key systems to operate within their smaller scale yet with the full functionality of modern day PBXs.

Small-to-medium sized companies may still prefer to use key systems instead of PBXs because of their cost. Technology is currently bringing together the worlds of voice and data transmissions to key systems. In addition to analogue signals, the modem key system is generally fully capable of handling digital signals as well, thus enabling it to work within a voice over internet protocol ("VoIP") environment. Nonetheless, interconnecting today's key systems with VoIP devices typically includes re-cabling and wiring at a customer's site, which is time and labor intensive.

SUMMARY

In one embodiment, the present Voice and Data Telecommunications Connector ("telecommunications connector") interconnects a standard Compact Integrated Communications System ("CICS") having a standard two-end connector to a converged voice and data telecommunications device having a standard 50-pin amphenol connector. In another embodiment, the present telecommunications connector interconnects a standard Modular Integrated Communications System ("MICS") having a standard three-end connector to a converged voice and data telecommunications device having a standard 50-pin amphenol connector. One benefit of the present telecommunications connector is that it enables fast and flexible connection between these two types of devices. It further eliminates re-cabling and wiring at a customer's site, thus saving time and money.

The present telecommunications connector provides a unique internal wiring pin-out and internal termination of these connectors for connecting CICS and MICS to converged voice and data telecommunications devices. The present telecommunications connector has a unique internal wiring make-up or "wiring pin-outs."

BRIEF DESCRIPTION OF THE DRAWINGS

FIG. 7 is a pin definition table for the telecommunications connector of FIG. 1 according to an embodiment of the present invention; and FIG. 8 is a pin definition table for the telecommunications connector of FIG. 2 according to an embodiment of the present invention.

DETAILED DESCRIPTION OF THE DRAWINGS

Figure 1:
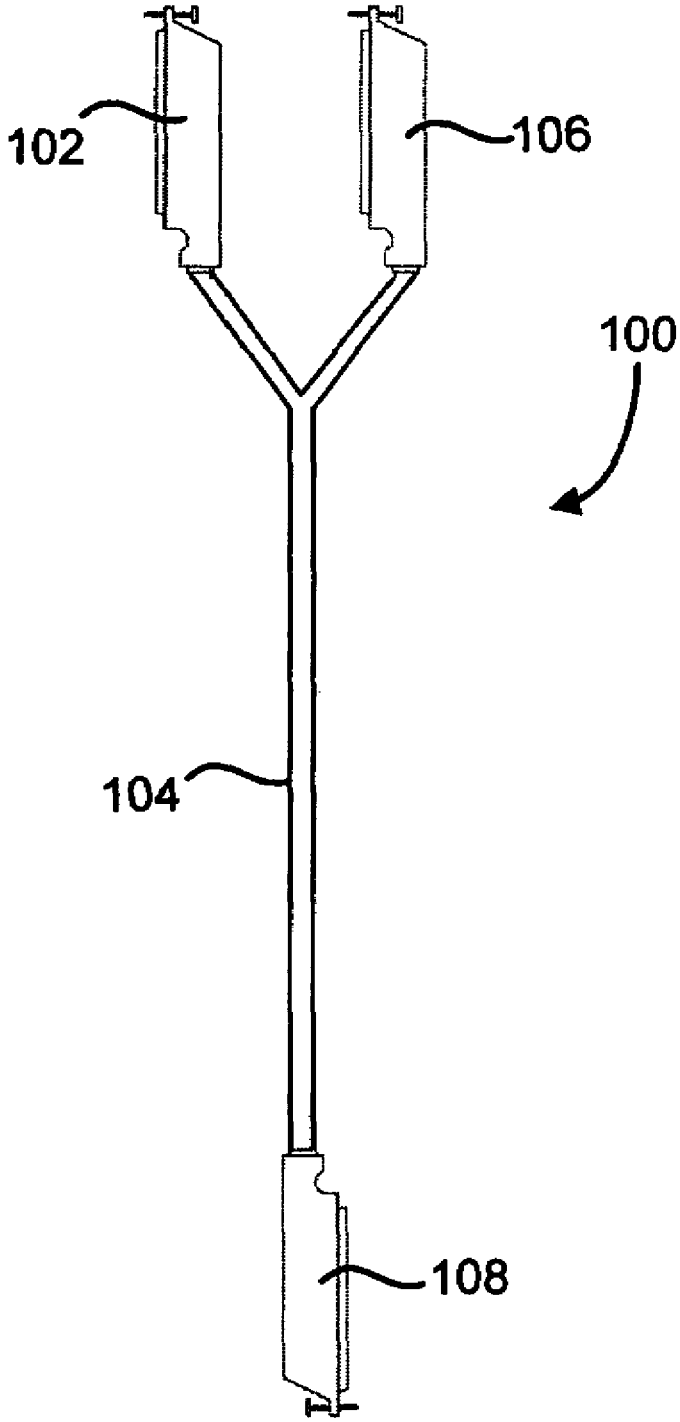
FIG. 1 illustrates a side view of a telecommunications connector according to an embodiment of the present invention.

In the drawings, like or similar elements are designated with identical reference numerals throughout the several views and figures thereof, and various depicted elements may not be drawn necessarily to scale. FIG. 1 illustrates an embodiment 100 of the present telecommunications connector that includes one end having a 50-pin amphenol BCM connector 108 and the other end having the two following connectors: a 50-pin amphenol trunk connector 102 and a 50-pin amphenol station connector 106. The 50-pin amphenol trunk connector 102 and 50-pin amphenol station connector 106 are connected to the 50-pin amphenol BCM connector 108 by a cable 104 that contains the wires that terminate in the respective 50-pin amphenol connectors, 102, 106, and 108, according to the pin definition table of FIG. 7.

Figure 2:
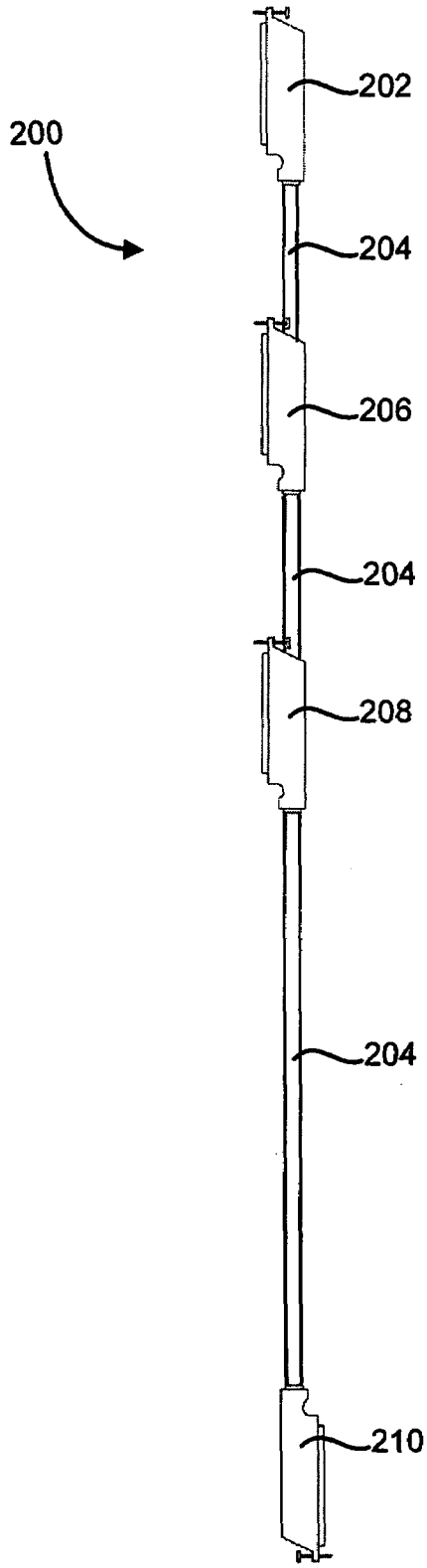
FIG. 2 illustrates a side view of a telecommunications connector according to another embodiment of the present invention.

FIG. 2 illustrates an embodiment 200 of the present telecommunications connector that includes one end having a 50-pin amphenol BCM connector 210 and the other end having the three following connectors: a 50-pin amphenol station connector 202, a 50-pin amphenol station and auxiliary connector 206, and a 50-pin amphenol trunk connector 208. These 50-pin amphenol connectors, 210, 202, 206, and 208, are connected to each other by a cable 204 that contains the wires that terminate in the respective connectors, 210, 202, 206, and 208, according to the pin definition table of FIG. 8.

Figure 3:
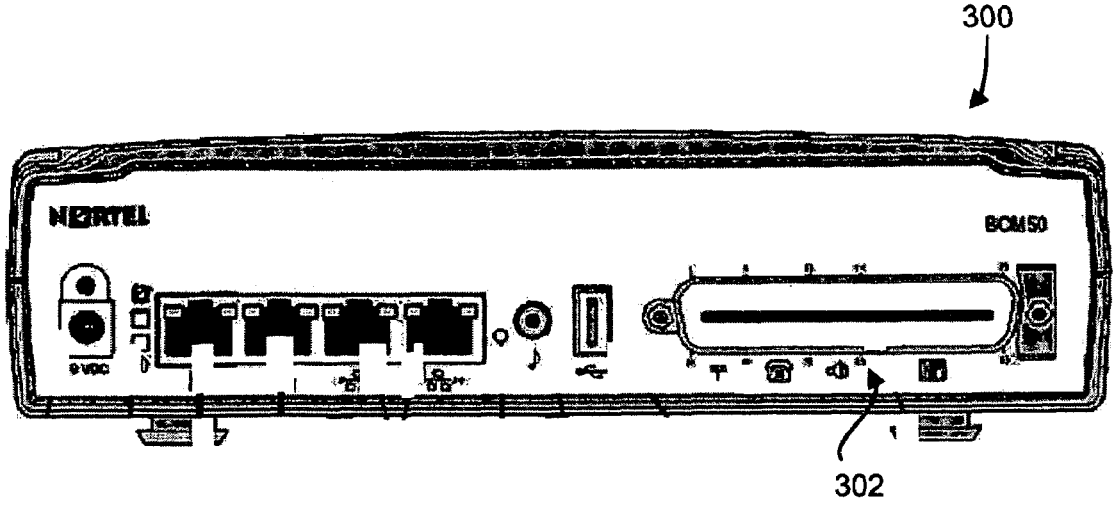
FIG. 3 illustrates a back view of a 50-pin amphenol connector for a converged voice and data telecommunication device for connecting to the telecommunications connector according to an embodiment of the present invention.

FIG. 3 illustrates a back view of an embodiment 300 of a converged voice and data telecommunication device ("BCM") having a 50-pin amphenol connector or socket 302 for connecting with telecommunications connectors 100 and 200 using amphenols 108 and 210 respectively.

Figure 4:
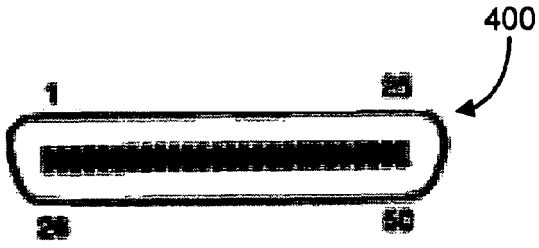
FIG. 4 illustrates an end view of a 50-pin amphenol connector for connecting one end of the telecommunications device of FIGS. 1 and 2 according to an embodiment of the present invention.

FIG. 4 illustrates an end view of an embodiment 400 of the 50-pin amphenol connectors 102, 106, 108, 210, 202, 206, and 208. The pin positions 1 through 50 are shown arranged with pin positions 1-25 and 26-50 opposite each other in the connector. In one aspect, one wire terminates in each of the pin locations of the 50-pin amphenol connectors 102, 106, 108, 210, 202, 206, and 208. In another aspect, a wire may not terminate in a pin location of the 50-pin amphenol connectors 102, 106, 108, 210, 202, 206, and 208.

Figure 5:
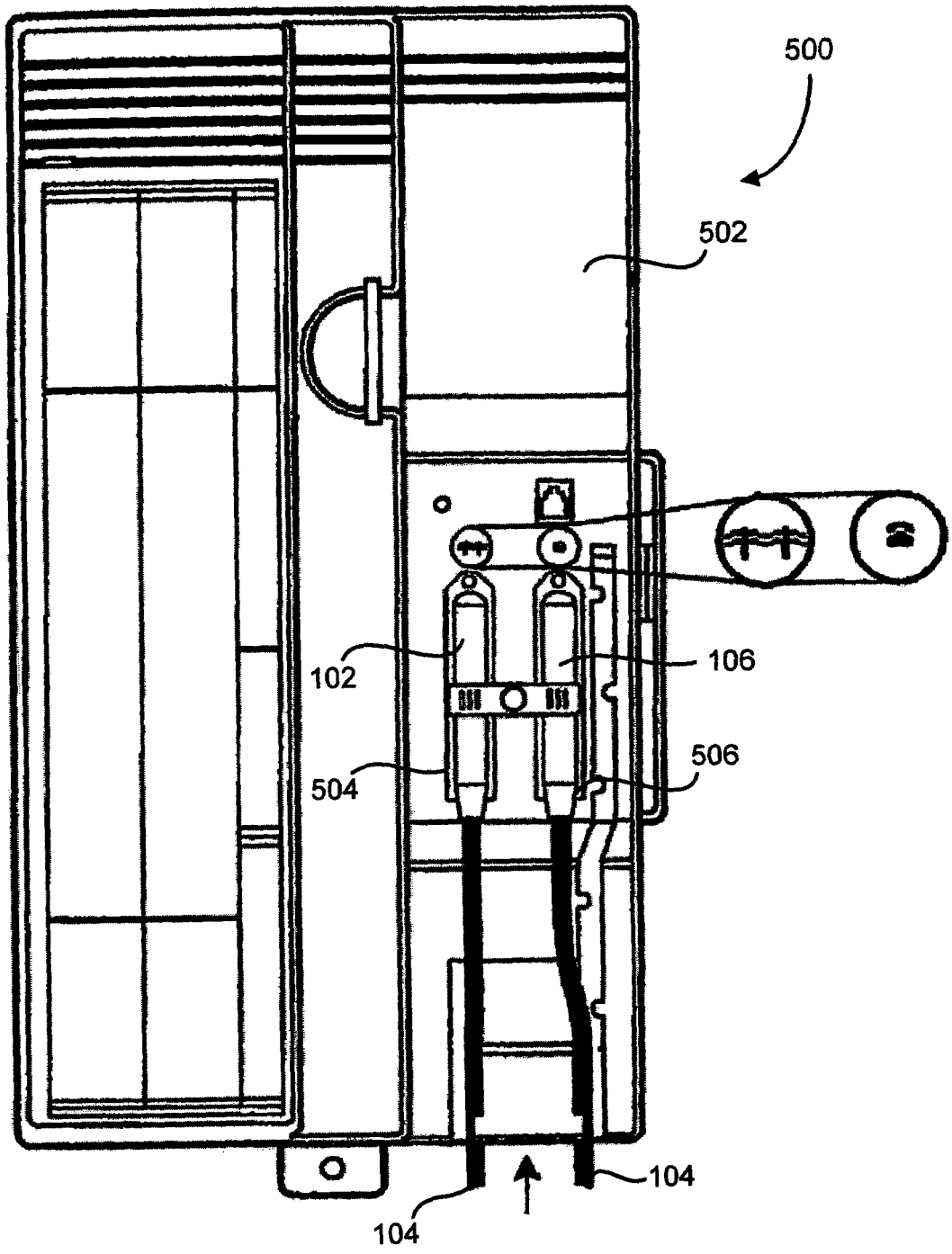
FIG. 5 illustrates a back view of the two connectors of a CICS for connecting the other end of the telecommunications connector of FIG. 1 according to an embodiment of the present invention.

FIG. 5 illustrates a back view of an embodiment 500 of a CICS 502 for connecting the other ends of the telecommunications connector 100. The CICS 502 has a 50-pin amphenol trunk connector or socket 504 for connecting with the 50-pin amphenol trunk connector 102 of the telecommunications connector 100. The CICS 502 further has a 50-pin amphenol station amp connector or socket 506 for connecting with the 50-pin amphenol station connector 106 of the telecommunications connector 100.

Figure 6:
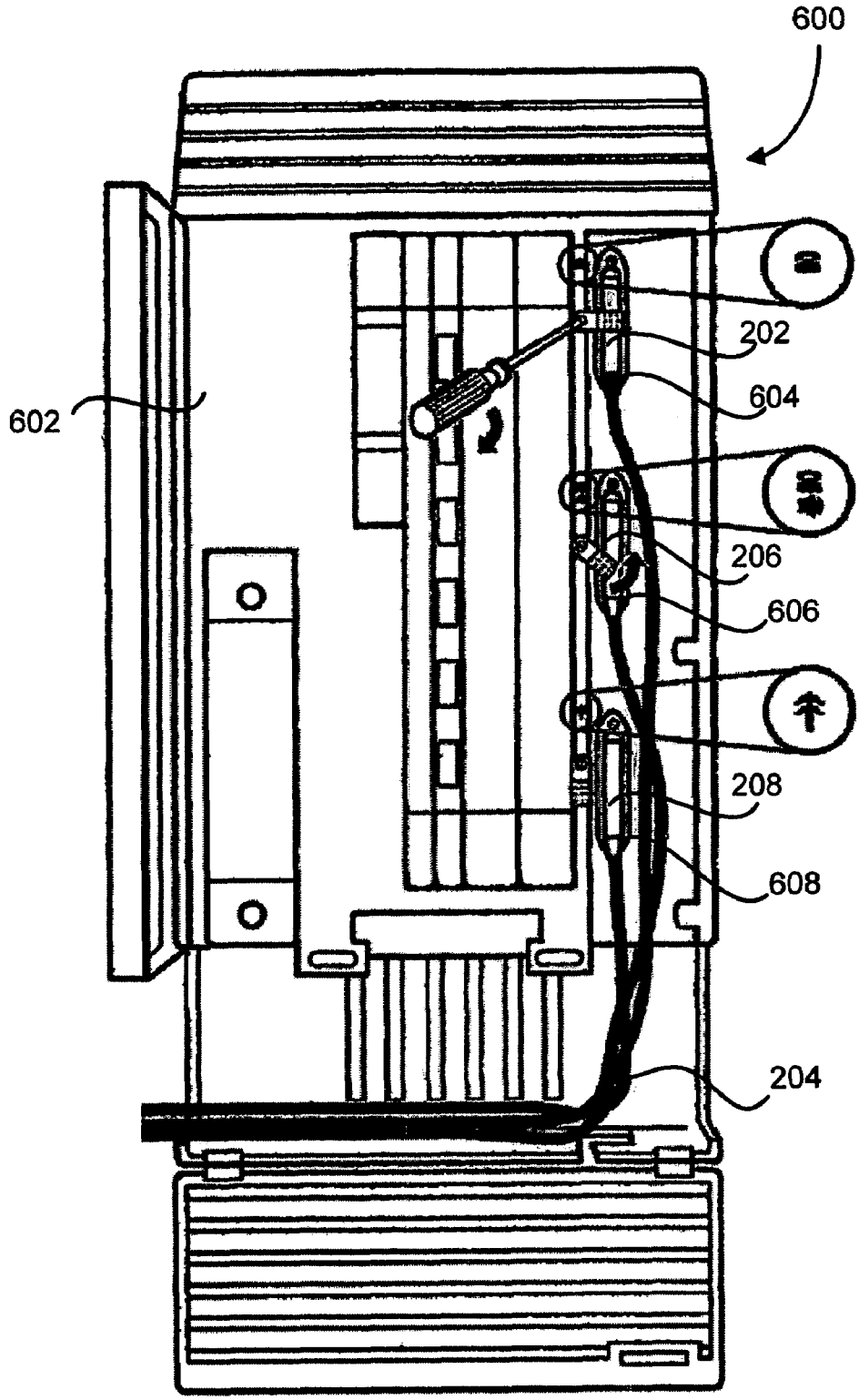
FIG. 6 illustrates a back view of the three connectors of a MICS for connecting the other end of the telecommunications connector of FIG. 2 according to an embodiment of the present invention.

FIG. 6 illustrates a back view of an embodiment 600 of a MICS 602 for connecting the other ends of the telecommunications connector 200. The MICS 602 has a 50-pin amphenol station connector or socket 604 for connecting with the 50-pin amphenol station connector 202 of the telecommunications connector 200. The MICS 602 further has a 50-pin amphenol station and auxiliary connector or socket 606 for connecting with the 50-pin amphenol station and auxiliary connector 206 of the telecommunications connector 200. In addition, the MICS 602 has a 50-pin amphenol trunk connector or socket 608 for connecting with the 50-pin amphenol trunk connector 208 of the telecommunications connector 200.

FIG. 7 is an embodiment 700 of a pin definition table for the telecommunications connector 100. Columns 702 and 704 are the wiring or pin definitions for the 108 of the telecommunications connector 100. Columns 706 and 708 are the wiring or pin definitions for the 50-pin amphenol trunk connector 102 of the telecommunications connector 100. For example, to connect Line 1 between the BCM 300 and the CICS 502, pins 1 and 26 of the 50-pin amphenol BCM connector 108 each have a wire connected to their respective pins that terminate at pins 1 and 26 of the 50-pin amphenol trunk connector 102, respectively. In another example, to connect Line 3 between the BCM 300 and the CICS 502, pins 3 and 28 of the 50-pin amphenol BCM connector 108 each have a wire connected to their respective pins that terminate at pins 5 and 30 of the 50-pin amphenol trunk connector 102, respectively. In yet another example, to connect Line 4 between the BCM 300 and the CICS 502, pins 4 and 29 of the 50-pin amphenol BCM connector 108 each have a wire connected to their respective pins that terminate at pins 6 and 31 of the 50-pin amphenol trunk connector 102, respectively.

Columns 710 and 712 are the wiring or pin definitions for the 50-pin amphenol station connector 106 of the telecommunications connector 100. For example, to connect an Analog 233 line between the BCM 300 and the CICS 502, pins 5 and 30 of the 50-pin amphenol BCM connector 108 each have a wire connected to their respective pins that terminate at pins 13 and 38 of the 50-pin amphenol station connector 106, respectively. In another example, to connect a Digital 221 line between the BCM 300 and the CICS 502, pins 25 and 50 of the 50-pin amphenol BCM connector 108 each have a wire connected to their respective pins that terminate at pins 1 and 26 of the 50-pin amphenol station connector 106, respectively. In yet another example, to connect an Aux Ringer between the BCM 300 and the CICS 502, pins 10 and 35 of the 50-pin amphenol BCM connector 108 each have a wire connected to their respective pins that terminate at pins 25 and 50 of the 50-pin amphenol station connector 106, respectively.

FIG. 8 is an embodiment 800 of a pin definition table for the telecommunications connector 200. Columns 802 and 804 are the wiring or pin definitions for the 50-pin amphenol BCM connector 210 of the telecommunications connector 200. Columns 806 and 808 are the wiring or pin definitions for the 50-pin amphenol trunk connector 208 of the telecommunications connector 200. For example, to connect Line 1 between the BCM 300 and the MICS 602, pins 1 and 26 of the 50-pin amphenol BCM connector 210 each have a wire connected to their respective pins that terminate at pins 1 and 26 of the 50-pin amphenol trunk connector 208, respectively. In another example, to connect Line 3 between the BCM 300 and the MICS 602, pins 3 and 28 of the 50-pin amphenol BCM connector 210 each have a wire connected to their respective pins that terminate at pins 5 and 30 of the 50-pin amphenol trunk connector 208, respectively. In yet another example, to connect Line 4 between the BCM 300 and the MICS 602, pins 4 and 29 of the 50-pin amphenol BCM connector 210 each have a wire connected to their respective pins that terminate at pins 6 and 31 of the 50-pin amphenol trunk connector 208, respectively.

Columns 810 and 812 are the wiring or pin definitions for the 50-pin amphenol station and auxiliary connector 206 of the telecommunications connector 200. For example, to connect an Aux Ringer between the BCM 300 and the MICS 602, pins 10 and 35 of the 50-pin amphenol BCM connector 210 each have a wire connected to their respective pins that terminate at pins 19 and 44 of the 50-pin amphenol station and auxiliary connector 206, respectively. In another example, to connect Music line between the BCM 300 and the MICS 602, pins 13 and 38 of the 50-pin amphenol BCM connector 210 each have a wire connected to their respective pins that terminate at pins 17 and 42 of the 50-pin amphenol station and auxiliary connector 206, respectively.

Columns 814 and 816 are the wiring or pin definitions for the 50-pin amphenol station connector 202 of the telecommunications connector 200. For example, to connect an Analog 233 line between the BCM 300 and the MICS 602, pins 5 and 30 of the 50-pin amphenol BCM connector 210 each have a wire connected to their respective pins that terminate at pins 13 and 38 of the 50-pin amphenol station connector 202, respectively. In another example, to connect a Digital 221 line between the BCM 300 and the MICS 602, pins 25 and 50 of the 50-pin amphenol BCM connector 210 each have a wire connected to their respective pins that terminate at pins 1 and 26 of the 50-pin amphenol station connector 202, respectively. In yet another example, to connect an Analog 236 line between the BCM 300 and the MICS 602, pins 8 and 33 of the 50-pin amphenol BCM connector 210 each have a wire connected to their respective pins that terminate at pins 16 and 41 of the 50-pin amphenol station connector 202, respectively.

In one embodiment, the 50-pin amphenol connectors, 102, 106, 108, 210, 202, 206, and 208, are 50-pin, 25-pair connectors that are commonly found in the telecommunications art. They may be commonly known by those skilled in the art as "Amphenol connectors," "Telco connectors," "RJ21 connectors," or "50-pin connectors." These 50-pin amphenol connectors 102, 106, 108, 210, 202, 206, and 208 may be what are commonly known left-handed or right-handed 50-pin amphenol connectors, as may be desirable for a particular application or device. Additionally, the 50-pin amphenol connectors 102, 106, 108, 210, 202, 206, and 208.

In one aspect, BCM 300 is a device that converges voice and data telecommunications signals. Some exemplary devices are those sold by Nortel®, such as the Business Communications Manager 50 ("BCM 50"). These type of devices provide voice and data capabilities to users, in one instance such as in a VoIP environment. Typically, BCM 300 provides telephone functionality in combination with IP access and applications to offer an IP-enabled, single-platform communications systems. They may handle such functions as routing, fax, voice messaging, and wireless capabilities.

In one aspect, CICS 502 is a scalable digital telephone system that may include the functionality of voice, mail, fax, email, computer, and telephones. An exemplary CICS 502 is the Compact Integrated Communications System by Nortel®. In addition, MICS 602 is a scalable digital key system that may also include voice, mail, fax, email, computer, and telephones. An exemplary MICS 602 is the Modular Integrated Communications System by Nortel®. The BCM 50 is a small business, IP capable system designed to replace the CICS and MICS systems.

In one aspect, the lines, such as Line 1, are POTS (plain old telephone service). In one aspect, the analog lines, such as Analog 233, can be used for fax machines, answering machines, cordless phones, alarm equipment, etc. In addition, the digital lines, such as Digital 221, with this tail, will match perfectly with the first 12 extensions of the existing equipment. The auxiliary ringer lines, such as 10 Aux Ringer, will allow for notification over an existing paging system or auxiliary horn. The page relay lines, such as 11 Page Relay, are a set of contacts that may be used with different page equipment applications. The page output, such as 12 Page Ouput, is the connection that the system uses to access the page equipment. The music lines, such as 13 Music, is the input point for music on hold and background music. When installing a BCM 50 at a customer site using this tail and a pre programmed system the customer's down time will be reduced to minutes since the cross-connecting will be done with the tail. The above mentioned connections will work perfectly with the existing equipment as they did before the change out.

There has been described a voice and data telecommunications connector. It should be understood that the particular embodiments described within this specification are for purposes of example and should not be construed to limit the invention. Further, it is evident that those skilled in the art may now make numerous uses and modifications of the specific embodiment described, without departing from the inventive concepts. For example, particular pin definitions may be changed or altered to fit within the connectors described herein or other connectors without departing from the inventive concepts.

What is claimed is:

1. A voice and data telecommunications connector comprising:

a set of wires each having a first end terminating in a first 50-pin amphenol connector for connecting to a 50-pin amphenol socket of a converged voice and data telecommunications device;

a first group of said set of wires each having a second end terminating in a 50-pin amphenol connector for connecting to a 50-pin amphenol trunk socket of a compact integrated communications system device; and a second group of said set of wires each having a second end terminating in a 50-pin amphenol connector for connecting to a 50-pin amphenol station socket of said compact integrated communications system device.

2. The voice and data connector of claim 1 wherein said first group comprises:

at least one pair of wires for connecting at least one line between said converged voice and data telecommunications device and said compact integrated communications device.

3. The voice and data connector of claim 1 wherein said second group comprises:

at least one pair of wires for connecting at least one digital line between said converged voice and data telecommunications device and said compact integrated communications device.

4. The voice and data connector of claim 1 wherein said second group comprises:

at least one pair of wires for connecting at least one analog line between said converged voice and data telecommunications device and said compact integrated communications device.

5. The voice and data connector of claim 1 wherein said first group comprises:

at least one pair of wires for connecting one of the group consisting of music, external page, and page between said converged voice and data telecommunications device and said compact integrated communications device.

6. The voice and data connector of claim 1 wherein said second group comprises:

at least one pair of wires for connecting an auxiliary ringer between said converged voice and data telecommunications device and said compact integrated communications device.

7. A voice and data telecommunications connector comprising:

a set of wires each having a first end terminating in a first 50-pin amphenol connector for connecting to a 50-pin amphenol socket of a converged voice and data telecommunications device;

a first group of said set of wires each having a second end terminating in a 50-pin amphenol connector for connecting to a 50-pin amphenol trunk socket of a modular integrated communications system device;

a second group of said set of wires each having a second end terminating in a 50-pin amphenol connector for connecting to a 50-pin amphenol station and auxiliary socket of said modular integrated communications system device; and a third group of said set of wires each having a second end terminating in a 50-pin amphenol connector for connecting to a 50-pin amphenol station socket of said modular integrated communications system device.

8. The voice and data connector of claim 7 wherein said first group comprises:

at least one pair of wires for connecting at least one line between said converged voice and data telecommunications device and said modular integrated communications system device.

9. The voice and data connector of claim 7 wherein said third group comprises:

at least one pair of wires for connecting at least one digital line between said converged voice and data telecommunications device and said modular integrated communications system device.

10. The voice and data connector of claim 7 wherein said third group comprises:

at least one pair of wires for connecting at least one analog line between said converged voice and data telecommunications device and said modular integrated communications system device.

11. The voice and data connector of claim 7 wherein said second group comprises:

at least one pair of wires for connecting one of the group consisting of music, external page, page, auxiliary ringer, between said converged voice and data telecommunications device and said modular integrated communications system device.

* * * * *